US009562324B2

(12) United States Patent
Wedel et al.

(10) Patent No.: US 9,562,324 B2
(45) Date of Patent: Feb. 7, 2017

(54) TURBULENCE BAR ASSEMBLY

(76) Inventors: Gregory L. Wedel, Kalamazoo, MI (US); Alan T. Ives, Marcellus, MI (US); Timothy N. Henry, Marcellus, MI (US)

( * ) Notice: Subject to any disclaimer, the term of this patent is extended or adjusted under 35 U.S.C. 154(b) by 971 days.

(21) Appl. No.: 13/099,885

(22) Filed: May 3, 2011

(65) Prior Publication Data

US 2012/0279080 A1 Nov. 8, 2012

(51) Int. Cl.
*F26B 11/12* (2006.01)
*D21F 5/02* (2006.01)
*D21F 5/10* (2006.01)

(52) U.S. Cl.
CPC ..... *D21F 5/028* (2013.01); *D21F 5/10* (2013.01); *Y10T 29/49826* (2015.01); *Y10T 137/9029* (2015.04)

(58) Field of Classification Search
USPC .... 34/179, 110, 108, 117; 403/202, 203, 24, 403/68 E; 405/132–153; 38/102.2; 210/495
See application file for complete search history.

(56) References Cited

U.S. PATENT DOCUMENTS

| | | | | |
|---|---|---|---|---|
| 2,376,502 | A * | 5/1945 | Overton | 34/110 |
| 3,217,426 | A * | 11/1965 | Barnschei et al. | 34/110 |
| 3,451,033 | A * | 6/1969 | Flachbarth | 439/100 |
| 3,550,389 | A * | 12/1970 | Bolotin et al. | 405/142 |
| 3,572,779 | A * | 3/1971 | Dawson | 285/382.2 |
| 3,724,094 | A | 4/1973 | Appel et al. | |
| 3,808,700 | A | 5/1974 | Kraus | |
| 4,195,417 | A | 4/1980 | Mathews | |
| 4,267,644 | A * | 5/1981 | Schiel | 34/110 |
| 4,282,656 | A | 8/1981 | Schiel | |
| 4,486,962 | A | 12/1984 | Wedel | |
| 4,538,360 | A | 9/1985 | Chance et al. | |
| 4,542,593 | A | 9/1985 | Viitanen et al. | |
| 4,674,196 | A | 6/1987 | Means | |
| 4,843,688 | A * | 7/1989 | Ikeda | 24/170 |
| H906 | H * | 4/1991 | Baggett et al. | 403/409.31 |
| 5,528,838 | A | 6/1996 | Timm et al. | |
| 6,695,524 | B2 * | 2/2004 | Monson et al. | 403/374.3 |
| 6,991,399 | B2 * | 1/2006 | Park et al. | 403/355 |
| 7,028,756 | B2 | 4/2006 | Ives et al. | |
| 7,178,582 | B2 | 2/2007 | Ives et al. | |
| 7,673,395 | B2 | 3/2010 | Timm et al. | |
| 2003/0213584 | A1 * | 11/2003 | Ives et al. | 165/90 |
| 2006/0179677 | A1 * | 8/2006 | Timm et al. | 34/110 |

FOREIGN PATENT DOCUMENTS

| | | | |
|---|---|---|---|
| DE | 10 2009 001593 | A1 | 9/2010 |
| EP | 1 362 951 | A2 | 11/2003 |
| EP | 1 419 879 | | 5/2004 |

* cited by examiner

*Primary Examiner* — Kenneth Rinehart
*Assistant Examiner* — Jason Lau
(74) *Attorney, Agent, or Firm* — Young Basile Hanlon & MacFarlane P.C.

(57) ABSTRACT

A turbulence bar assembly for a cylinder that extends in an axial direction includes a plurality of bars that extend in the axial direction and at least one hoop. The at least one hoop has one or more hoop segments that are connected to the plurality of bars and one or more couplers that are in engagement with the one or more hoop segments to expand and contract a radial dimension of the at least one hoop in response to movement of an adjustment block in the axial direction.

21 Claims, 6 Drawing Sheets

TURBULENCE BAR ASSEMBLY

TECHNICAL FIELD

The disclosure relates to the field of steam-heated cylinders, and more particularly, to a turbulence bar assembly for steam-heated cylinders.

BACKGROUND

Steam-heated rotating cylinders are utilized in a number of industries for producing and processing various materials, such as paper. For example, a web of paper can be dried by passing it over one or more heated cylinders. In the corrugating industry, the cylinders are often less than two feet in diameter and can be ten to fifteen feet in length. Steam is introduced into the cylinder through a rotating seal, also known as a rotary joint. The steam inside the cylinder transfers its heat to a web of material that is disposed on the outside of the cylinder through the shell of the cylinder. As the heat is transferred from the hot steam to the web, the steam inside the cylinder condenses. The condensate thus formed is then removed from the cylinder through a syphon pipe that is connected to an external pipe or tank through the rotary joint.

At low rotational speeds, the residual condensate inside the cylinder will tend to accumulate in a puddle at the bottom of the cylinder, which is referred to as a "ponding" state. As the rotational speed of the cylinder increases, the condensate in the puddle will begin to rotate with the cylindrical shell but fall back into the puddle as it nears the top of the cylinder. This is referred to as a "cascading" state. At high rotational speeds, the condensate follows the cylinder around the entire inside periphery of the cylindrical shell in a state that is referred to as "rimming."

When the cylinder is rotated, the water is rotated along with the cylinder itself, and the added weight of the water requires that an increased rotational force be applied to rotate the cylinder. In order to minimize the power required to rotate the cylinders in the ponding and cascading states, and to maximize the transfer of heat through the condensate in the rimming state, the syphon pipe is typically designed to minimize the amount of condensate that is disposed within the cylinder.

At high rotational speeds, the rimming layer of condensate is very stagnant and forms an insulating barrier between the steam inside the cylinder and the inside surface of the cylindrical shell of the cylinder. Even thin residual layers of condensate can provide significant resistance to the transfer of heat from the steam to the cylindrical shell.

It is known that generating turbulence in the rimming layer increases the rate of convective heat transfer through the condensate layer. Turbulence bars have been previously used for this purpose. Turbulence bars are disposed within the cylinder and are held against the inside surface of the cylindrical shell by various means. The turbulence bars generate turbulence in the rimming layer of the condensate that forms between the individual bars. This increase in condensate turbulence increases the rate of heat transfer and tends to improve the uniformity of heat transfer from the cylinder.

Various structures have been developed for fixing turbulence bars within the interior of the cylinder. These structures include magnets, springs, pins, and bolts. The bars are typically held to the inside surface of the cylindrical shell of the cylinder using a plurality of hoops or hoop segments that are pressed toward the inner surface of the cylindrical shell.

For example, one prior art design uses a threaded turnbuckle with locking nuts that interconnects two hoop segments and can be adjusted to press the hoop segments outward. As another example, some prior art designs place springs between hoop segments to press the hoop segments outward.

SUMMARY

Turbulence bar assemblies and drying cylinders including turbulence bar assemblies are taught herein.

One turbulence bar assembly is taught herein for use with a cylinder that extends in an axial direction. The turbulence bar assembly includes a plurality of bars that extend in the axial direction and at least one hoop. The at least one hoop has one or more hoop segments that are connected to the plurality of bars and one or more couplers that are in engagement with the one or more hoop segments to expand and contract a radial dimension of the at least one hoop in response to movement of an adjustment block in the axial direction.

One drying cylinder taught herein includes a cylinder that extends in an axial direction. The cylinder has an interior surface. The drying cylinder also includes a turbulence bar assembly that is disposed within the cylinder. The turbulence bar assembly includes a plurality of bars that extend in the axial direction. A plurality of hoops are connected to the plurality of bars and are spaced axially with respect to one another. The hoops have one or more hoop segments that are connected to the plurality of bars and one or more couplers that include a housing, a substantially wedge-shaped adjustment block, and a threaded fastener that threadedly engages the adjustment block to move the adjustment block with respect to the housing in the axial direction in response to rotation of the threaded fastener with respect to the adjustment block. The couplers are in engagement with the one or more hoop segments to expand and contract a radial dimension of a respective hoop of the plurality of hoops in response to movement of a substantially wedge-shaped adjustment block in the axial direction, and expansion of the radial dimension of the respective hoop is operable to engage the plurality of bars with the interior surface of the cylinder.

A method of installing a turbulence bar assembly in an interior of a cylinder that extends in an axial direction is also taught herein. The method includes the step of connecting one or more hoop segments to one or more couplers and to a plurality of turbulence bars outside of the cylinder, the one or more couplers each having an adjustment block that is moveable in the axial direction of the cylinder to expand and contract a radial dimension of the one or more hoops. The method also includes the steps of adjusting the coupler to reduce the radial dimension of the first hoop while the first hoop is outside the cylinder, moving the first hoop and the turbulence bars into the interior of the cylinder, and adjusting the coupler of the first hoop to expand the radial dimension of the coupler while the first hoop is disposed within the interior of the cylinder to engage the turbulence bars with the cylinder.

BRIEF DESCRIPTION OF THE DRAWINGS

The various features, advantages and other uses of the present apparatus will become more apparent by referring to the following detailed description and drawings in which.

DETAILED DESCRIPTION

Turbulence bars are normally assembled in place within the steam-heated drying cylinder of a cylindrical dryer. To avoid disassembling the cylinder, the turbulence bar assembly is typically installed through a removable port that is cast in the end of the cylinder. The components of the turbulence bar assembly are sized to be passed through the port, and then the turbulence bar assembly is assembled after it is inside the cylinder. This circumstance complicates the task of assembling the turbulence bar assembly. The task of assembling the turbulence bar assembly is further complicated when the cylinder is sized such that an installer who is assembling the turbulence bar assembly is not able to physically enter the cylinder due to the small size of the cylinder.

Figure 1:
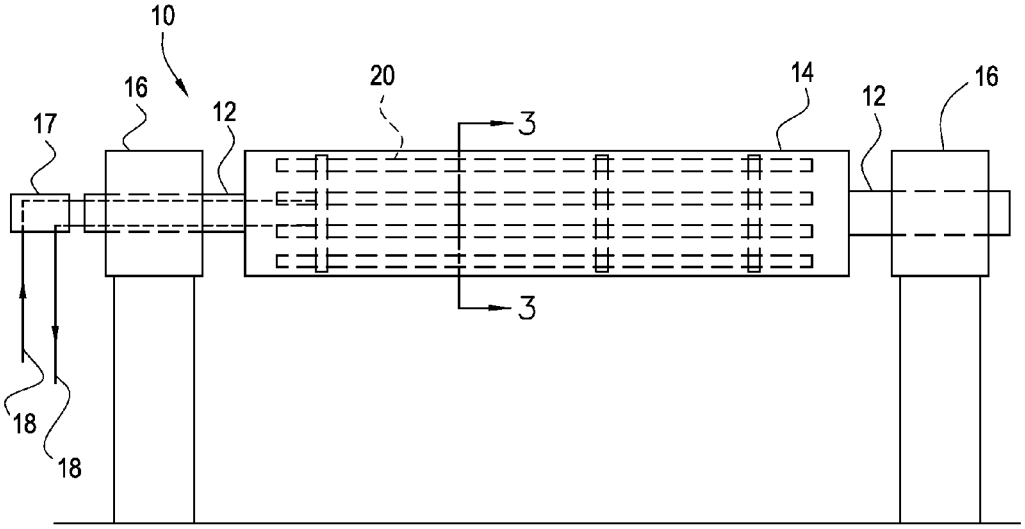
FIG. 1 shows a cylindrical dryer having a turbulence bar assembly.

FIG. 1 shows a cylindrical dryer 10 having a turbulence bar assembly 20. The cylindrical dryer 10 includes a pair of journals 12 that support a cylinder 14. The journals 12 are fixed with respect to a supporting surface, such as a floor. The cylinder 14 is supported with respect to the journals 12 by bearing assemblies 16 including bearings and bearing housings that connect each end of the cylinder 14 to one of the journals 12. One or more conduits 18 is in communication with the cylinder 14 through a rotary joint 17 for supplying and removing any or all of steam, water, and air to the cylinder 14.

Figure 2:
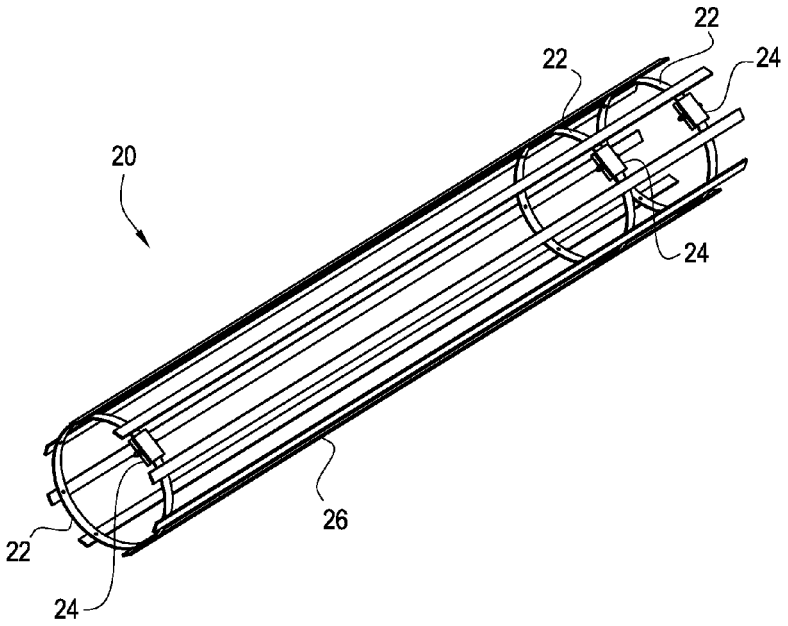
FIG. 2 is a perspective view showing the turbulence bar assembly.
Figure 3:
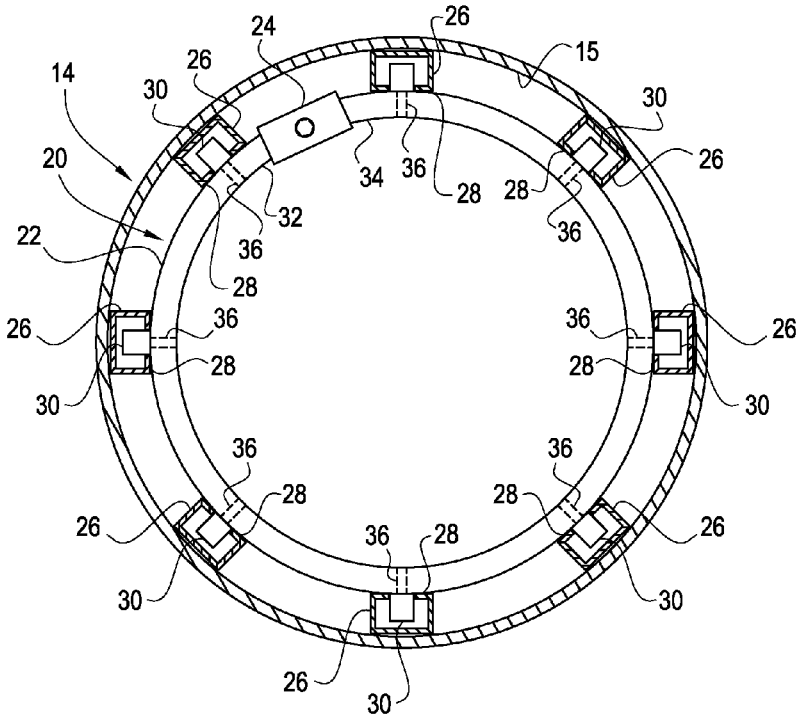
FIG. 3 is a cross-sectional view of a cylinder of the cylindrical dryer of FIG. 1.

As shown in FIGS. 2-3, the turbulence bar assembly 20 includes one or more hoops 22 and one or more turbulence bars 26. The hoops 22 are defined by one or more hoop segments 23 and one or more couplers 24. In the illustrated embodiment, the turbulence bar assembly 20 includes three hoops 22, each having one hoop segment 23 and one coupler 24, and eight turbulence bars 26 that are each connected to the three hoops 22 at spaced locations along the turbulence bars 26. This configuration can be utilized, for example, with a cylinder 14 having a 20" diameter. As shown, a single hoop 22 is positioned adjacent to a first end of the turbulence bar assembly 20, while a pair of hoops 22 are positioned adjacent to one another and both adjacent to a second end of the turbulence bar assembly 20. This configuration may enhance the ability of the turbulence bar assembly 20 to remain fixed in place with respect to the cylinder 14 when subjected to thermal expansion. The hoops 22 could, however, be placed at any desired spacing with respect to one another, such as equal spacings. The numbers of hoops 22, couplers 24, and turbulence bars 26, could be modified for particular applications.

The turbulence bars 26 are elongate with their long dimension extending in the axial direction of the cylinder 14. When installed inside the cylinder 14, the turbulence bars 26 are in engagement with an interior surface 15 of the cylinder 14.

The turbulence bars 26 could be hollow, tubular structures. The cross-section of each turbulence bar 26 could be square, rectangular, polygonal, or any other suitable cross-sectional shape.

Apertures 28 are formed in the turbulence bars 26 to allow connection of the turbulence bars 26 to the hoops 22. For example, the apertures 28 could be configured to receive pins 30 that engage the apertures 28 to connect the hoops 22 and the turbulence bars 26. The pins 30 could be of the type described in U.S. Pat. No. 7,178,582 or could be of any other suitable design now known or later developed.

The hoops 22 are substantially circular structures that are defined by the hoop segments 23 and the couplers 24. To allow engagement with the couplers 24, the hoops 22 are discontinuous and extend less than a complete circle. The hoop segments 23 each extend between a first end portion 32 and a second end portion 34, each of which are in engagement with one of the couplers 24.

Figure 4A:
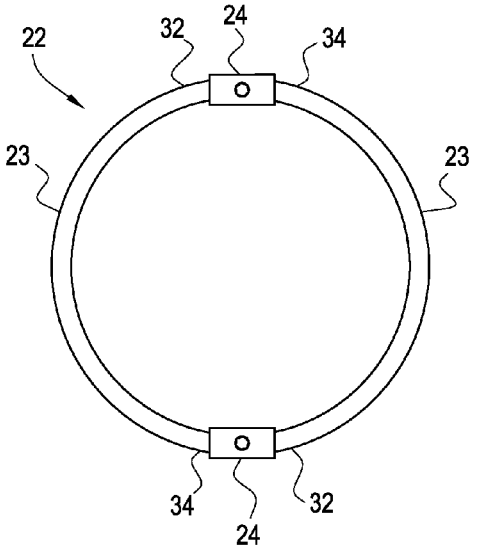
FIG. 4A shows a hoop that includes a pair of hoop segments that are interconnected by two couplers.
Figure 4B:
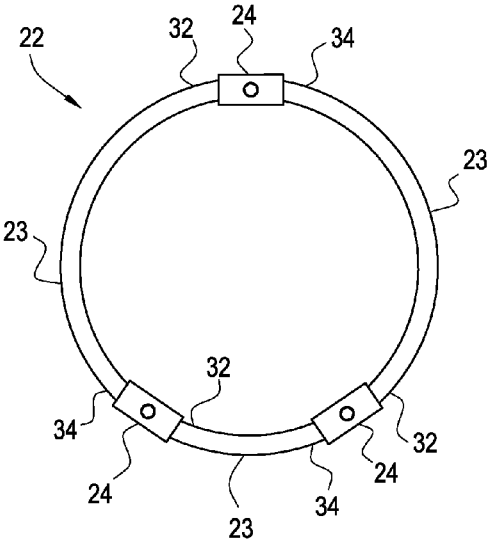
FIG. 4B shows a hoop that includes three hoop segments that are interconnected by three couplers.

The hoop 22 may be defined by a single hoop segment 23 and a single coupler 24 (FIG. 3). Alternatively, each hoop 22 could be formed from multiple hoop segments 23, as shown in FIGS. 4A-4B. As an example, two hoop segments 23 could be provided as part of the hoop 22, in which case, two couplers 24 would be provided (FIG. 4A). As another example, three hoop segments 23 could be provided, in which case three couplers 24 would be provided (FIG. 4B). Any other number of hoop segments 23 could be provided to define the hoop 22, and generally, the couplers 24 and the hoop segments 23 would be provided in equal numbers.

To connect the hoops 22 to the turbulence bars 26, apertures 36 are formed through the hoops 22. The apertures 36 extend radially and are at spaced locations around the periphery of the hoop segments 23. The apertures 36 are configured to receive portions of the pins 30. The engagement of the pins 30 with the apertures 36 in the hoop segments 23 as well as with the apertures 28 in the turbulence bars 26 restrains the turbulence bars 26 from moving with respect to the hoops 22.

Figure 5:
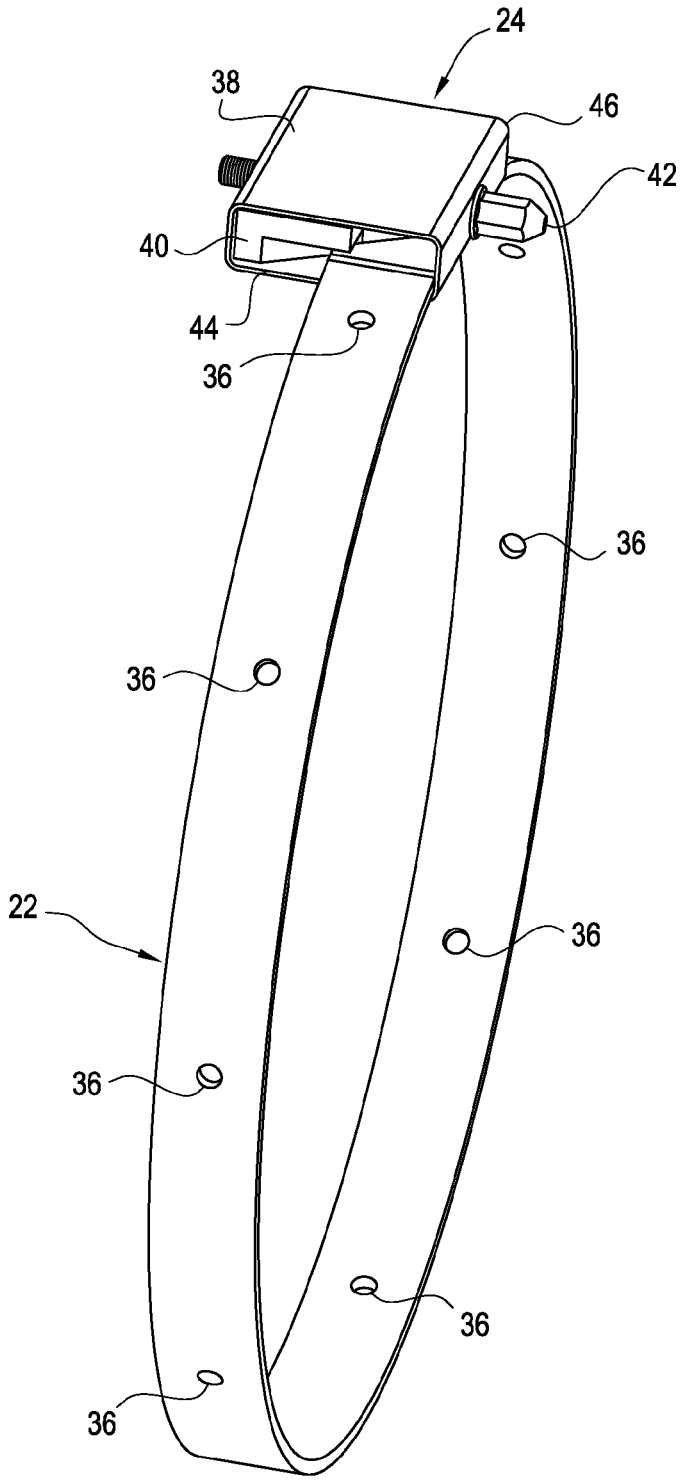
FIG. 5 is a perspective view showing a hoop and coupling device of the turbulence bar assembly.
Figure 6:
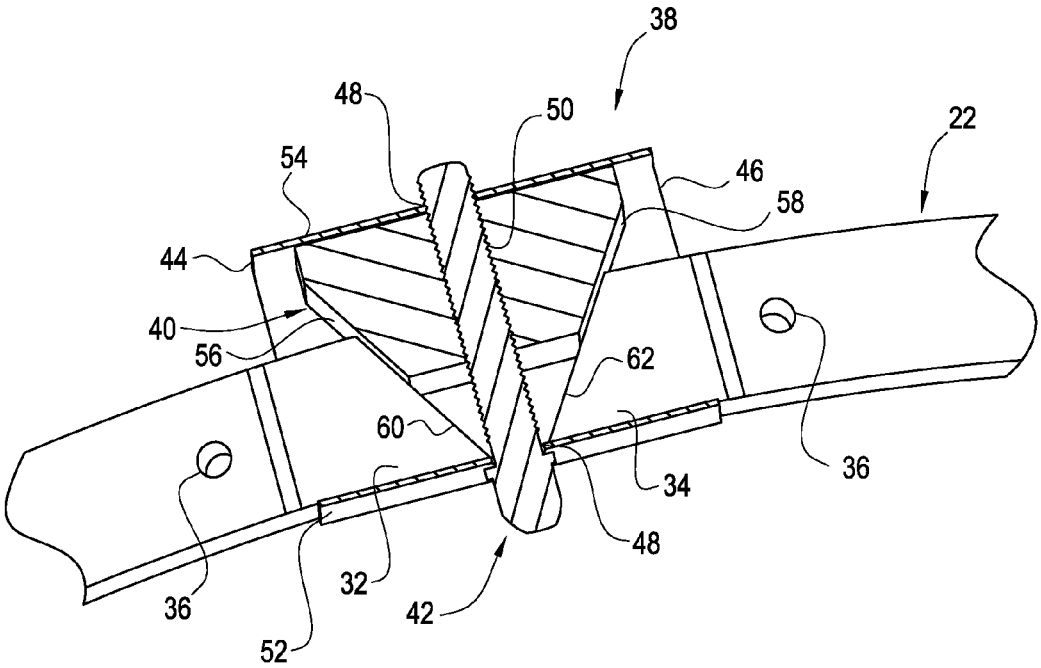
FIG. 6 is a cross-sectional view of the coupler of FIG. 5, showing engagement of the coupler with the hoop.

As shown in FIGS. 5-6, the coupler 24 includes a housing 38, an adjustment block 40, and a threaded fastener 42.

The housing 38 may be generally rectangular in configuration and extend from a first open end 44 to a second open end 46. For example, the housing 38 could be a section of hollow rectangular tube. Apertures 48 are formed in the housing 38 opposite one another for receiving the threaded fastener 42.

The adjustment block 40 includes a threaded aperture 50. The adjustment block 40 is disposed within the housing 38 such that the threaded aperture 50 is in registration with the apertures 48 of the housing 38. Accordingly, the threaded fastener 42 extends through the threaded aperture 50 of the adjustment block 40, as well as through the apertures 48 of the housing 38.

Threaded engagement of the adjustment block 40 with the threaded fastener 42 causes the adjustment block 40 to advance and retract within the housing 38 in response to rotation of the threaded fastener 42. In particular, the adjustment block 40 is moveable from a second end 54 of the housing 38 to a first end 52 of the housing 38. Movement of the adjustment block 40 with respect to the housing 38 is operable to establish multiple positions of the adjustment block 40 with respect to the housing 38, such that varying distances between each of the first end 52 and the second end 54 of the housing 38 from the adjustment block are established. For example, a first position and a second position of the adjustment block 40 with respect to the housing 38 could be established such that the first position is characterized by a first distance between the adjustment block 40 and the first end 52 of the housing 38, and the second position is characterized by a second, smaller distance that is established between the first end 52 of the housing 38 and the adjustment block 40.

Advancement and retraction of the adjustment block 40 is operable to move the first and second end portions 32, 34 of the one or more of the hoop segments 23 inward and outward with respect to the housing 38, either by direct engagement of the adjustment block 40 with the hoop segments 23 or by indirect engagement of the adjustment block 40 with the hoop segments 23. When the first and second end portions 32, 34 of the hoop 22 move outward with respect to the housing 38, the radial dimension of the hoop 22 increases. This allows the turbulence bars 26 to be moved toward and held in engagement with the interior surface 15 of the cylinder 14. Movement of the first and second end portions 32, 34 of the hoop 22 outward with respect to the housing 38 causes the radial dimension of the hoop 22 to decrease. This allows the force exerted upon the turbulence bars 26 by the hoop 22 to be decreased so that the turbulence bars 26 can be partially or fully disengaged with respect to the interior surface 15 of the cylinder 14 or the hoop 22 itself.

An example of direct engagement between the adjustment block 40 and the hoop 22 is depicted in FIGS. 5-6. The adjustment block 40 is in the form of a wedge that is defined by a first tapered surface 56 and a second tapered surface 58 that are formed on the adjustment block 40 opposite one another and on opposite sides of the threaded fastener 42. Thus, the adjustment block 40 could be a substantially wedge-shaped adjustment block. The first tapered surface 56 is adjacent to and faces the first open end 44 of the housing 38, while the second tapered surface 58 is adjacent to and faces the second open end 46 of the housing 38.

Direct engagement of the adjustment block 40 with the hoop segments 23 occurs via engagement of the first and second tapered surfaces 56, 58 of the adjustment block 40 with a first tapered surface 60 that is formed on the first end portion 32 of one of the hoop segments 23 of the hoop 22 and a second tapered surface 62 that is formed on the second end portion 34 of one of the hoop segments 23 of the hoop 22. The first and second tapered surfaces 56, 58 of the adjustment block 40 and the first and second tapered end surfaces 60, 62 of the hoop segments 23 of the hoop 22 are configured such that the first and second end portions 32, 34 are moved outward toward the first open end 44 and the second open end 46 of the housing 38 as the adjustment block 40 is moved from the second end 54 of the housing 38 toward the first end 52 of the housing 38. As an example, each of the first and second tapered surfaces 56, 58 of the adjustment block 40 could form acute angles with respect to the first and second open ends 44, 46 of the housing 38, in which case the first and second tapered end surfaces 60, 62 of the hoop 22 would be angled complementarily.

Figure 7:
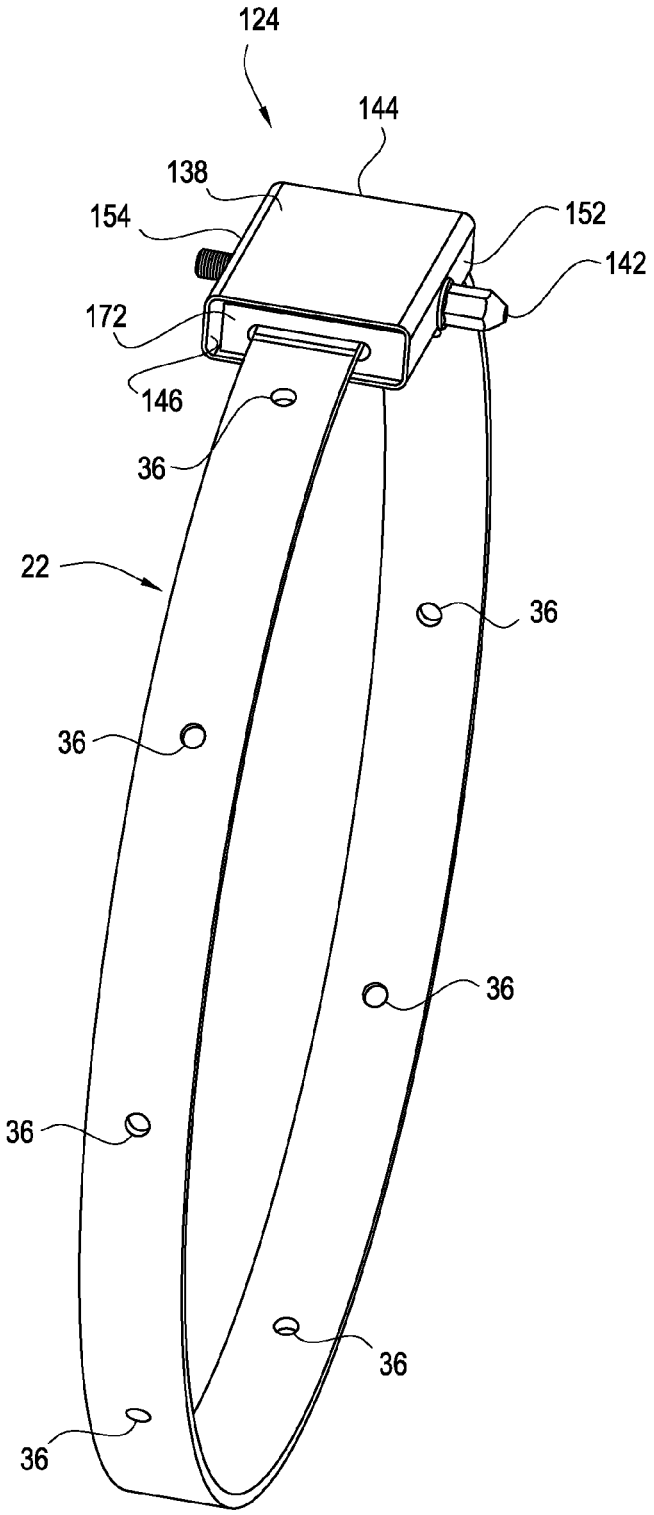
FIG. 7 is a perspective view showing a coupler and hoop according to a second embodiment.
Figure 8:
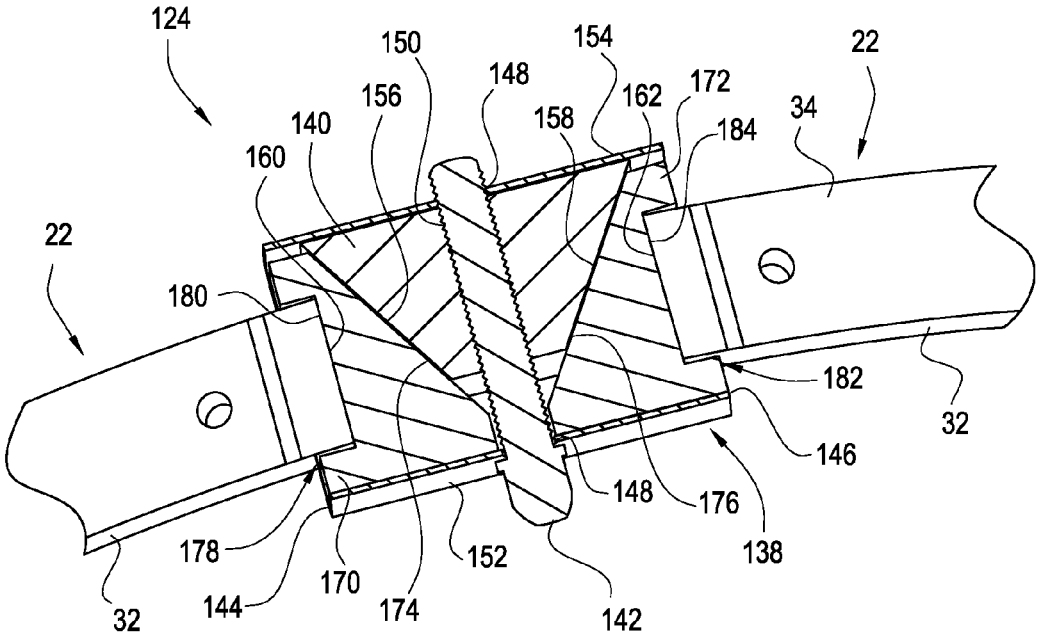
FIG. 8 is a cross-section of the coupler of the second embodiment showing engagement with the hoop.

An alternative coupler 124 is shown in FIGS. 7-8 and is configured to move the first and second end portions 32, 34 of the hoop 22 outward or inward, thereby changing the radial dimension of the hoop 22 by indirect engagement of an adjustment block 140 with the first and second end portions 32, 34 of the hoop segments 23 of the hoop 22.

The coupler 124 includes a housing 138 that is identical in all relevant respects to the housing 38 of the coupler 24. The housing 138 includes a first open end 144, a second open end 146, apertures 148, a first end 152, and a second end 154, all of which are as described with respect to equivalent portions of the housing 38.

The coupler 124 includes an adjustment block 140. The structure of the adjustment block 140 and its operation relative to a threaded fastener 142 are as described with respect to the adjustment block 40 and the threaded fastener 42. The adjustment block 140 includes a threaded aperture 150, a first tapered surface 156, and a second tapered surface 158, all of which are as described with respect to equivalent components of the adjustment block 40.

The adjustment block 140 does not engage the first and second end portions 32, 34 of the hoop segments 23 of the hoop 22 directly. The first and second end portions 32, 34 are in engagement with a first side rail 170 and a second side rail 172. The first side rail 170 has a first tapered engagement surface 174 that is engageable with the first tapered surface 156 of the adjustment block 140 and operates similar to the first tapered surface 60 of the hoop 22. The second side rail 172 has a second tapered engagement surface 176 that is engageable with the second tapered surface 158 of the adjustment block 140 and functions similarly to the second tapered end surface 62 of the hoop 22.

The first side rail 170 has a first recess 178 formed opposite the first tapered engagement surface 174. The first recess 178 includes an interior surface 180 that does not define a significant angle with respect to the first open end 144 of the housing 138. That is to say that the first interior surface 180 is substantially parallel to the plane defined by the first open end 144 of the housing 138.

The second side rail 172 has a second recess 182 formed opposite the second tapered engagement surface 176. The second recess 182 includes an interior surface 184 that does not define a significant angle with respect to the second open end 146 of the housing 138. Thus, the second interior surface 184 is substantially parallel to the plane defined by the second open end 146 of the housing 138.

Advancement and retraction of the adjustment block 140 with respect to the housing 138 between the first end 152 and second end 154 of the housing 138 are as described with respect to the adjustment block 40 and the housing 38, including movement between first and second positions. The adjustment block 140 indirectly engages a first straight surface 160 that is formed on the first end portion 32 of one of the hoop segments 23 of the hoop 22 and a second straight surface 162 that is formed on the second end portion 34 of one of the hoop segments 23 of the hoop 22. The first and second straight surfaces 160, 162 are disposed within the first recess 178 and the second recess 182 of the first side rail 170 and the second side rail 172, respectively. Thus, the first and second straight surfaces 160, 162 are engageable with the first and second interior surfaces 180, 184 of the first and second side rails 170, 172. The first end portion 32 and the second end portion 34 of the hoop segments 23 of the hoop 22 are also engageable with the interior of the first recess 178 and the second recess 182 in order to restrain motion of the first and second end portions 32, 34 of the hoop segments 23 of the hoop 22 in a radial direction.

The first and second tapered surfaces 156, 158 of the adjustment block 140 and the first and second tapered engagement surfaces 174, 176 of the first and second side rails 170, 172 are configured such that the first and second side rails 170, 172 are moved outward toward the first open end 144 and the second open end 146 of the housing 138 as the adjustment block is moved from the second end 154 of the housing 138 toward the first end 152 of the housing 138. The first side rail 170 and the second side rail 172 are in engagement with the first and second end portions 32, 34 of the hoop segments 23 of the hoop 22. This causes the first and second end portions 32, 34 to move outward toward the first and second open ends 144, 146 of the housing 138 in response to movement of the first side rail 170 and the second side rail 172.

In any of the foregoing embodiments, serrations can be provided on first and second tapered surfaces 56, 58, the first and second end portions 32, 34, the first and second tapered engagement surfaces 174, 176, and the tapered surfaces 156, 158 to enhance engagement between the surfaces and lock the respective parts in desired positions with respect to one another. The serrations could be micro serrations. In order to fix the position of the threaded fastener 42 or the threaded fastener 142, a serrated locking washer, a serrated flanged head, or a self-locking adhesive can be provided.

In operation, the turbulence bar assembly 20 is installed by first positioning the hoop segments 23 adjacent to but outside of the end of the cylinder 14. The turbulence bars 26 are then connected to the hoop segments 23, such as by pins 30. One of the couplers 24 is then installed between the first and second end portions 32, 34 of the hoop segments 23 with the adjustment block 40 fully retracted, that is, positioned adjacent to the second end 54 of the housing 38. The turbulence bar assembly 20 is then slid into the cylinder 14. Additional hoops 22 are added as the turbulence bar assembly 20 is slid into the cylinder 14, such that the hoops 22 are installed just prior to entry into the cylinder 14. After all of the hoops 22 are in place, and the turbulence bar assembly 20 is placed into its final axial position within the cylinder 14, the couplers 24 are utilized to expand the hoops 22, thereby fixing the position of the turbulence bar assembly 20 within the cylinder 14. Expansion of the radial dimension of the hoops 22 is operable to engage the turbulence bars 26 with the interior surface 15 of the cylinder 14. This may be done using a hex head socket wrench having an extension rod of suitable length to reach the threaded fastener 42 of each coupler 24 from the exterior of the cylinder 14. After the turbulence bar assembly 20 is installed, the cylindrical dryer 10 may be operated in the usual manner.

The disclosure is directed to what is presently considered to be the most practical and preferred embodiment. It is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A turbulence bar assembly for a cylinder that extends in an axial direction, the turbulence bar assembly comprising:

a plurality of bars that extend in the axial direction; and at least one hoop having:

an arcuate body that extends from a first end to a second end, wherein the arcuate body is connected to the plurality of bars, and a coupler that includes a housing, an adjustment block that is disposed within the housing, and a threaded fastener having a head portion and a threaded portion, the head portion of the fastener is disposed outside of the housing, and the threaded portion of the fastener is in engagement with a threaded aperture of the adjustment block, wherein the first end of the arcuate body and the second end of the arcuate body are each disposed within the housing and in engagement with the coupler to expand and contract a radial dimension of the arcuate body in response to movement of the adjustment block in the axial direction in response to rotation of the threaded fastener with respect to the adjustment block.

2. The turbulence bar assembly of claim 1, wherein the adjustment block is substantially wedge-shaped.

3. The turbulence bar assembly of claim 1, wherein the threaded fastener extends in the axial direction of the cylinder.

4. The turbulence bar assembly of claim 1, wherein the housing extends from a first open end to a second open end, the first end of the arcuate body is disposed in the housing at the first open end of the housing, and the second end of the arcuate body is disposed in the housing at the second open end of the housing.

5. The turbulence bar assembly of claim 4, wherein the housing is tubular.

6. The turbulence bar assembly of claim 1, wherein the first end of the arcuate body and the second end of the arcuate body are in engagement with the adjustment block of the coupler.

7. The turbulence bar assembly of claim 2, wherein the adjustment block includes a first side rail that engages the first end of the arcuate body and a second side rail that engages the second end of the arcuate body, wherein the first and second side rails each include a tapered surface that is in engagement with the adjustment block of the coupler.

8. A turbulence bar assembly for a cylinder that extends in an axial direction, the turbulence bar assembly comprising:

a plurality of bars that extend in the axial direction; and a plurality of hoops that are connected to the plurality of bars and are spaced axially with respect to one another, the hoops having one or more hoop segments that are connected to the plurality of bars and one or more couplers that include a housing, an adjustment block having at least one tapered surface, and a threaded member that threadedly engages the adjustment block to move the adjustment block with respect to the housing in the axial direction in response to rotation of the threaded member with respect to the adjustment block, wherein the couplers are in engagement with the one or more hoop segments to expand and contract a radial dimension of a respective hoop of the plurality of hoops in response to movement of the adjustment block.

9. The turbulence bar assembly of claim 8, wherein the threaded member extends in the axial direction of the cylinder and the adjustment block moves in the axial direction of the cylinder.

10. The turbulence bar assembly of claim 8, wherein the housing extends from a first open end to a second open end and the hoop segments of the respective hoop of the plurality of hoops are at least partially receivable within the first and second open ends of the housing.

11. The turbulence bar assembly of claim 10, wherein at least a portion of the housing is tubular.

12. The turbulence bar assembly of claim 8, wherein the hoop segments include tapered end surfaces that are in engagement with the adjustment block of the one or more couplers.

13. The turbulence bar assembly of claim 8, wherein the one or more couplers include side rails that are each in engagement with one of the hoop segments and include a tapered surface that is in engagement with the adjustment block of a respective coupler of the one or more couplers.

14. The turbulence bar assembly of claim 8, wherein the adjustment block includes tapered surfaces having serrations formed thereon.

15. A drying cylinder, comprising:

a cylinder that extends in an axial direction, the cylinder having an interior surface;

a turbulence bar assembly that is disposed within the cylinder, the turbulence bar assembly including a plurality of bars that extend in the axial direction; and a plurality of hoops that are connected to the plurality of bars and are spaced axially with respect to one another, the hoops having one or more hoop segments that are connected to the plurality of bars and one or more couplers that include a housing, an adjustment block having at least one tapered surface, and a threaded fastener that threadedly engages the adjustment block to move the adjustment block with respect to the housing in the axial direction in response to rotation of the threaded fastener with respect to the adjustment block, wherein the couplers are in engagement with the one or more hoop segments to expand and contract a radial dimension of a respective hoop of the plurality of hoops in response to movement of the adjustment block in the axial direction, and expansion of the radial dimension of the respective hoop is operable to engage the plurality of bars with the interior surface of the cylinder.

16. A method of installing a turbulence bar assembly in an interior of a cylinder that extends in an axial direction, comprising the steps of:

connecting one or more hoop segments to one or more couplers to define at least a first hoop and connecting the first hoop to a plurality of turbulence bars outside of the cylinder, the one or more couplers each having an adjustment block that is moveable in the axial direction of the cylinder to expand and contract a radial dimension of the first hoop;

adjusting the coupler to reduce the radial dimension of the first hoop while the first hoop is outside the cylinder;

moving the first hoop and the turbulence bars into the interior of the cylinder; and adjusting the coupler of the first hoop to expand the radial dimension of the coupler while the first hoop is disposed within the interior of the cylinder to engage the turbulence bars with the cylinder.

17. The turbulence bar assembly of claim 1, wherein the arcuate body includes a plurality of hoop segments that are connected to one another by one or more additional couplers.

18. The turbulence bar assembly of claim 1, wherein the adjustment block includes at least one tapered surface.

19. The turbulence bar assembly of claim 1, wherein the adjustment block includes a first tapered surface and a second tapered surface that are disposed on opposites sides of the threaded aperture of the adjustment block.

20. The turbulence bar assembly of claim 1, wherein the housing includes a first wall, a second wall that is axially spaced from the first wall, and a first aperture that extends through the first wall, wherein the threaded fastener extends through the first aperture.

21. The turbulence bar assembly of claim 1, wherein the first end of the arcuate body and the second end of the arcuate body are each engageable with at least a portion of the coupler to restrain movement of the first end of the arcuate body and the second end of the arcuate body, respectively, with respect to the coupler in a radial direction of the arcuate body.

* * * * *